US006229430B1

(12) United States Patent
Smith Dewey

(10) Patent No.: US 6,229,430 B1
(45) Date of Patent: May 8, 2001

(54) SYSTEM AND METHOD FOR ALERTING A USER

(76) Inventor: Mary Smith Dewey, 1710 Crowberry Dr., Dallas, TX (US) 75228

( * ) Notice: Subject to any disclaimer, the term of this patent is extended or adjusted under 35 U.S.C. 154(b) by 0 days.

(21) Appl. No.: 09/507,390

(22) Filed: Feb. 18, 2000

(51) Int. Cl.[7] ..... G08B 9/00

(52) U.S. Cl. ..... 340/286.02; 340/384.1; 340/309.15; 368/11

(58) Field of Search ..... 340/286.02, 384.1, 340/384.7, 384.71, 384.72, 384.73, 309.15, 309.4, 309.3, 601; 368/11

(56) References Cited

U.S. PATENT DOCUMENTS

| | | | | |
|---|---|---|---|---|
| 4,097,690 | | 6/1978 | Kuntz et al. | 179/2 |
| 4,122,660 | * | 10/1978 | Canavan | 58/16.5 |
| 5,373,488 | | 12/1994 | Lidor | 368/13 |
| 5,402,396 | | 3/1995 | Jones | 368/250 |
| 5,422,862 | | 6/1995 | Wisor | 368/10 |
| 5,497,141 | * | 3/1996 | Coles et al. | 340/309.15 |
| 5,640,145 | | 6/1997 | Newham | 340/573 |
| 5,764,153 | | 6/1998 | Vedaa | 340/666 |
| 5,786,768 | * | 7/1998 | Chan et al. | 340/632 |
| 5,802,158 | | 9/1998 | Jeong | 379/198 |
| 5,832,067 | * | 11/1998 | Herold | 379/110.01 |
| 5,877,676 | * | 3/1999 | Shankarappa | 340/309.15 |
| 6,057,769 | * | 5/2000 | Stevenson | 340/601 |

* cited by examiner

*Primary Examiner*—Jeffery Hofsass
*Assistant Examiner*—Daniel Previl
(74) *Attorney, Agent, or Firm*—Baker Botts L.L.P.

(57) ABSTRACT

An alert system (100) for alerting a user is disclosed. The alert system (100) comprises an input (102) for setting alarm conditions, and an interface (110) for coupling to a communication network (114) to obtain alarm data from a data source (118). The alert system (100) further comprises an alarm (124) for alerting the user in response to an alarm signal, and a processor (106). The processor (106) is operable to receive the alarm conditions, to control communication network (114) access to the data source (118), to receive and evaluate alarm data, and to generate the alarm signal in response to the evaluation. More specifically, the alarm signal may be based on information such as traffic or weather.

27 Claims, 2 Drawing Sheets

SYSTEM AND METHOD FOR ALERTING A USER

TECHNICAL FIELD OF THE INVENTION

This invention relates generally to the field of alarm clocks and, more specifically, to a system and method for alerting a user.

BACKGROUND OF THE INVENTION

Many people in this world have jobs that require starting work at a certain time. In addition, many people have appointments or meetings, in which they cannot be late. These are a few of the reasons alarm clocks were invented. Alarm clocks alert people at a pre-selected time chosen by the user. Users set an alarm to go off at a time that allows them enough time to get ready and commute to work or to attend an appointment. A problem arises when there is an accident on the route the user usually follows, or if the weather creates traffic problems or other delays. These and other reasons will cause people to be late to work or miss a meeting, which could be harmful. On the other hand, many people may also desire a little extra time for sleeping if the traffic is particularly light one morning or if, for example, the weather causes a delay in a flight they are scheduled to take that morning. For these and many other reasons, users desire an alarm clock or alerting system that will provide an alarm or alert at a desirable time.

Alarm clocks have been developed that take into account bad weather. For example, U.S. Pat. No. 4,122,660 to Canavan discloses a snow alarm that allows the user to pre-set two wake-up times: one for normal conditions, and one for "snowy" conditions. A physical snow sensor set-up outside a user's home will trigger the earlier time if snow accumulates overnight. However, the '660 Patent relies on a physical device that detects only snow accumulation in the immediate vicinity of the user. Prior devices do not allow for monitoring traffic conditions or weather conditions remote from the user. Also, such systems do not allow for either a multiplicity of pre-set or post-set wake-up times, or a myriad of conditions that would change the alarm time.

The challenges in the field of alarm clocks have continued to increase with demands for more and better techniques having greater flexibility and reliability. In addition, with the wealth of information readily available nowadays, especially because of the internet, world wide web, and other data sources, a need has arisen for a new system and method for alerting a user.

SUMMARY OF THE INVENTION

In accordance with the present invention, a system and method for alerting a user is provided that substantially eliminates or reduces disadvantages and problems associated with previously developed systems and methods.

A system for alerting a user is disclosed. The system comprises an input for establishing alarm conditions, and an interface for coupling to a communication network to obtain alarm data from a data source. The system further comprises a processor, and an alarm for alerting the user in response to an alarm signal generated by the processor. The processor is operable to receive the alarm conditions, to control access to the data source over the communication network, to receive and evaluate alarm data, and to generate the alarm signal in response to the evaluation. More specifically, the alarm signal may be based on information such as traffic or weather.

A method for alerting a user is disclosed. The method comprises four steps. Step one calls for inputting alarm conditions where one of the alarm conditions is a first alert time. Step two requires receiving data from at least one data source, in which the data corresponds to a selected event. Step three calls for computing a second alert time, which may differ from the first alert time, in response to the data and the alarm conditions. The last step requires activating an alarm at the second alert time. The second alert time may be based on data such as information concerning traffic or weather conditions.

Another method for alerting a user is also disclosed. The method comprises six steps. Step one calls for inputting user information having an alert time and alarm conditions. Step two requires setting an alarm to activate an audio signal at the alert time. Step three calls for coupling to a web source, while step four calls for querying the web source using the alarm conditions. Step five requires receiving data concerning the alarm conditions from the web source. The last step calls for modifying the alert time when the alarm conditions exist. More specifically, the actual alert time may be automatically adjusted based on data such as information related to traffic or weather conditions.

A technical advantage of the present invention is that an alert time may be automatically set, and a user alerted, based upon updated data concerning traffic or weather conditions.

Another technical advantage of the present invention is that the great wealth of information contained on the world wide web or other data sources may be accessed to allow a user to efficiently manage his or her lifestyle. For example, avoidance of tardiness to work or appointments, as well as maximizing the amount of sleep one gets, may be accomplished.

An additional technical advantage of the present invention is that advertising may be substituted for an alarm signal. This is beneficial for entities trying to market products or services to users. The advertising may be targeted toward a particular user, and may include such things as advertisements for breakfast bars or coffee.

A further technical advantage of the present invention is that the alarm clock can either be connected to the Internet using a wireline or wireless connection. The user may be able to take the alarm clock "on the road."

Other technical advantages are readily apparent to one skilled in the art from the following figures, descriptions, and claims.

BRIEF DESCRIPTION OF THE DRAWINGS

For a more complete understanding of the invention, and for further features and advantages, reference is now made to the following description, taken in conjunction with the accompanying drawings, in which.

DETAILED DESCRIPTION OF THE INVENTION

Figure 1:
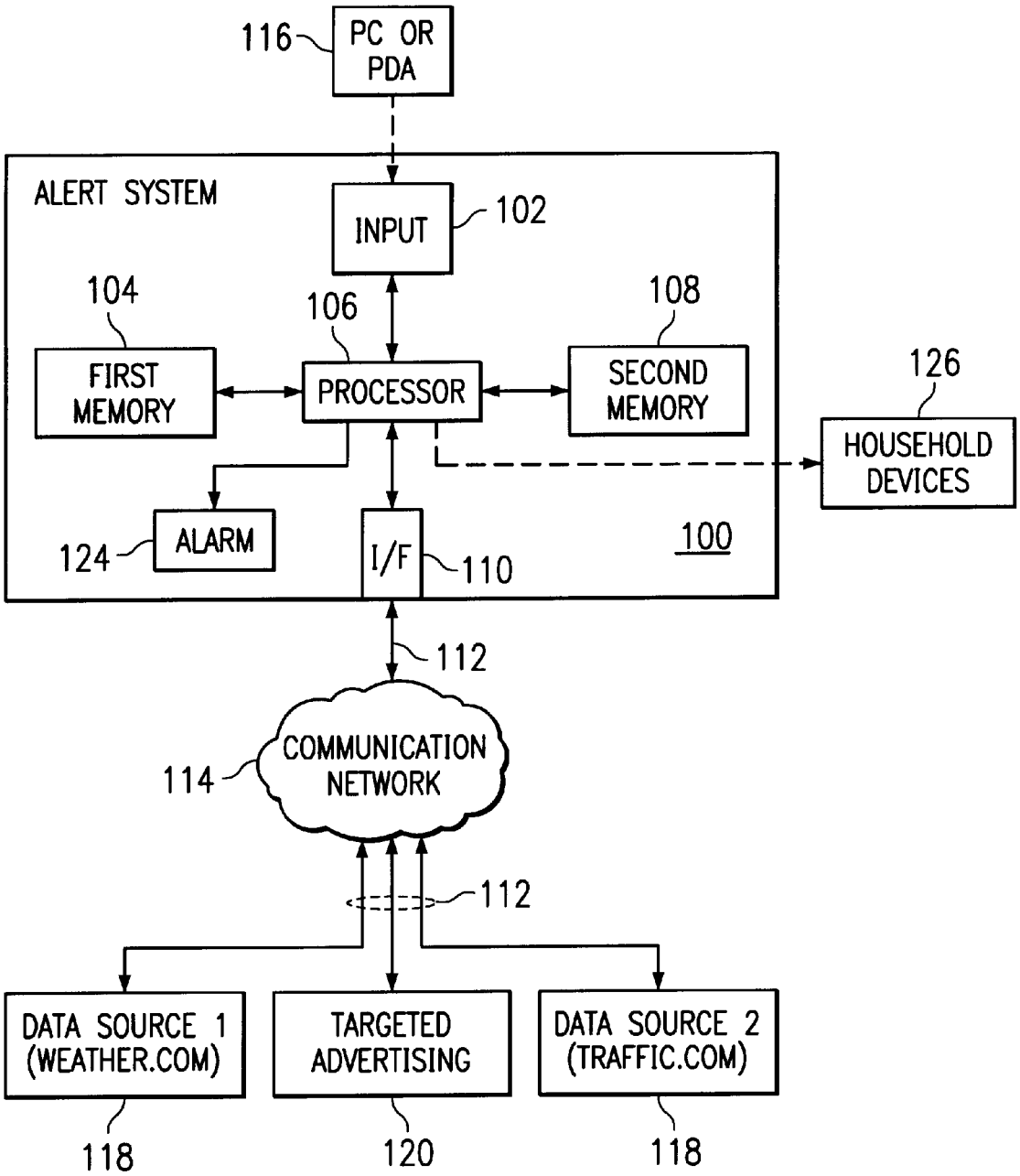
FIG. 1 is a schematic view illustrating a system for alerting a user in accordance with the present invention.
Figure 2:
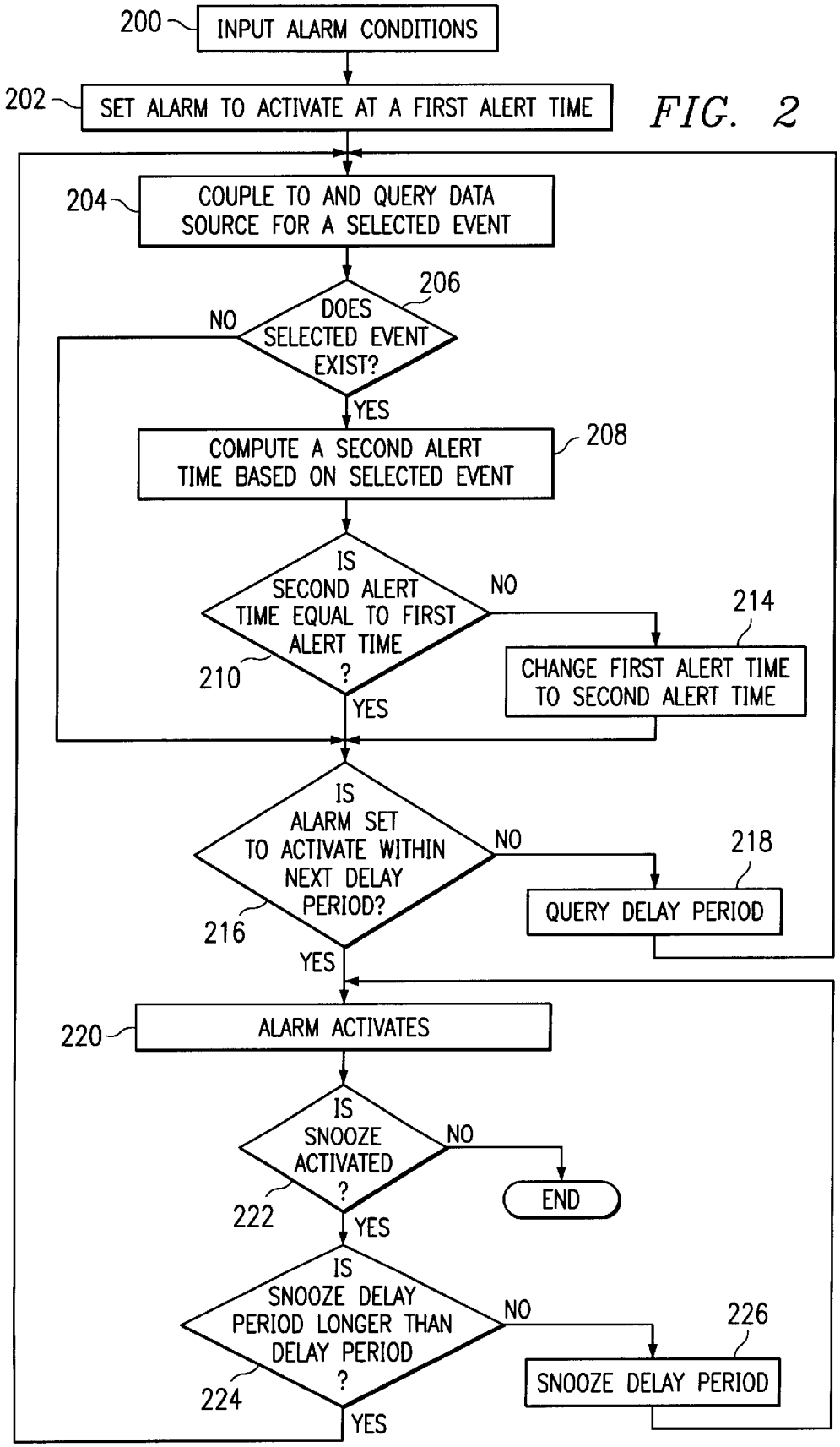
FIG. 2 is a flowchart demonstrating a method for alerting a user in accordance with the present invention.

The preferred embodiments of the present invention and its advantages are best understood by referring now in more detail to FIGS. 1 and 2 of the drawings, in which like numerals refer to like parts.

FIG. 1 is a schematic view illustrating an alert system 100 for alerting a user in accordance with the present invention.

In one embodiment, alert system 100 comprises an input 102, a processor 106, an interface 110, and an alarm 124. Input 102 is for establishing alarm conditions that relate to information about a user. These conditions may be such things as an initial alert time, various pre-set alert times, various post-set alert times, the user's location and driving route, which data sources 118 to query and which events to query about, or any other desired conditions determined by the user to be relevant to a determination of whether or not alarm 124 needs to activate at a different alert time. Input 102 may be a keypad, data card, or any other conventional signal input. Input 102 may also receive the alarm conditions from a personal computer ("PC") or personal data assistant ("PDA") 116 as shown in FIG. 1.

Interface 110 is for coupling alert system 100 to a communication network 114 so as to obtain alarm data from data sources 118. Interface 110 may be any combination of hubs, routers, bridges, gateways, firewalls, switches, remote access devices, or any other hardware, software, firmware, or combination thereof operable to facilitate communication between alert system 100 and data sources 118 using communication network 114 and links 112. Interface 110 may be, for example, a cable modem, digital subscriber line, 10/100 base-T Ethernet port, fiber optic connection, or dial-up connection. In one embodiment, links 112 are wireline connections such as any conventional telephone lines, cables, or fiber optics. However, the connections between interface 110, communication network 114, and data sources 118 may be wireless.

Communication network 114 may comprise a global computing network, a virtual private network ("VPN"), a local area network ("LAN"), a wide area network ("WAN"), a powerline area network ("PAN"), or any other suitable communication network that facilitates communication of data between alert system 100 and data sources 118. In one embodiment, communication network 114 uses a point-to-point tunneling protocol ("PPTP") to communicate data between alert system 100 and data sources 118, using a computer network such as the internet. Data sources 118 may be any conventional data sources, in which data can be accessed, transmitted, and evaluated. In one embodiment, data sources 118 are websites, such as weather.com, traffic.com, or delta-airlines.com. Data received from data sources 118 are dependent upon the alarm conditions input by input 102, and are used by processor 106 to evaluate whether or not alarm 124 needs to activate at a different alert time than the initially set alert time.

Processor 106 may comprise any conventional type of central processing unit ("CPU") associated with an operating system that executes logic. As mentioned, one of the functions of processor 106 is to receive the alarm conditions from input 102 and store them in a first memory 104. First memory 104 may comprise a file, a stack, a database, or any other suitable organization of volatile or nonvolatile memory. First memory 104 can be random access memory ("RAM"), read-only memory ("ROM"), CD-ROM, removable memory devices, or any other suitable devices that allow storage or retrieval of data. Processor 106 further operates to control access to data sources 118 and targeted advertising 120 through communication network 114. Processor 106 also operates to receive and evaluate alarm data that is received from data sources 118. This alarm data will be stored in a second memory 108. Second memory 108 may comprise a file, a stack, a database, or any other suitable organization of volatile or nonvolatile memory. Second memory 108 can be RAM, ROM, CD-ROM, removable memory devices, or any other suitable devices that allow storage or retrieval of data. Processor 106 will generate an alarm signal in response to an evaluation of the alarm conditions stored in first memory 104 and the alarm data stored in second memory 108. In another embodiment, first memory 104 stores the alarm data, and second memory 108 stores the alarm conditions.

Still referring to FIG. 1, processor 106 may generate an alarm signal that activates an alarm 124 so as to alert a user. Alarm 124 may be any conventional type of buzzer or sound used in conventional alarm clocks, or alarm 124 may be other types of indicators such as a light source, music source, or audio messages such as advertising. This advertising may be targeted towards a particular user, and as shown in box 120 of FIG. 1, interface 110 will communicate through communication network 114 to retrieve targeted advertising 120. This targeted advertising may be advertising for any types of products or services, such as advertising for breakfast bars, coffee, or retirement funds.

In another embodiment of the present invention, alert system 100 may be coupled to one or more household devices 126 as shown in FIG. 1. Household devices 126 may comprise, as examples, the coffee pot, toaster, or microwave. Household devices 126 may be coupled to alert system via processor 106, and this may be a wireline or wireless connection. This embodiment allows, for example, coffee to be ready when the user awakens at a pre-set or post-set alert time, which was automatically determined from the data received from data sources 118 by alert system 100.

FIG. 2 is a flowchart illustrating one method of alerting a user in accordance with the present invention. In one embodiment, the alarm conditions as described above are input into alert system 100 at step 200. An alarm is set to activate at a first alert time at step 202. This first alert time is, for example, the normal time a user would want to wake-up in the morning to go to work. At step 204, interface 110 operates to couple to and query data sources 118 for at least one selected event. These selected events may be part of the conditions that were input at step 200, and as an example, a selected event may be that it is snowing. In this case, a data source such as the website weather.com would be queried. A decision is made at step 206 to determine whether or not any of the selected events exist in data sources 118. If a selected event exists, then a second alert time is computed based on this selected event at step 208, and the method continues at step 210 as outlined below. If a selected event does not exist, then a second alert time is not computed, and the method continues at step 216 as outlined below. Using the snow example, if weather.com indicates that it is snowing, then a second alert time will be computed at step 208. This second alert time may be one of various pre-set times that were input into alert system 100 by input 102, or may be calculated on some other basis. This would allow a user to get out of bed earlier than normal so he or she can be sure to make it to work on time.

At step 210, another decision is made. Step 210 asks whether or not the second alert time is equal to the first alert time as input at step 200. If the second alert time is not equal to the first alert time, then the first alert time is changed to the second alert time at step 214. If the second alert time is equal to the first alert time, then the first alert time is not changed to the second alert time. In either case, the next step 216 is that a further decision is made on whether or not the alarm is set to activate within the next query delay period. If the alarm is not set to go off in the next query delay period, then a query delay period results at step 218, and the query cycle is repeated starting at step 204. As an example, a query delay period may be 15 minutes. However, it is understood that any duration may be used for the query delay period. If the alarm is set to activate within the next query delay period at step 216, then the alarm will activate at step 220 when the appropriate alert time is reached. This will alert the user that, for example, it is time to get out of bed.

Alert system 100 may also comprise a snooze switch. If the snooze switch is activated at step 222, then a question will be asked at step 224 as to whether or not the snooze delay period is longer than the query delay period. If the snooze delay period is longer than the query delay period, then the query cycle will be repeated starting at step 204. However, if the snooze delay period is not longer than the query delay period, then the snooze delay period takes place at step 226 and the alarm will activate at step 220 when the snooze delay period ends. Then the question will be asked again on whether or not the snooze is activated. This cycle will repeat until the snooze is not activated at step 222 which ends the method of alerting the user.

Another example that shows the flexibility of the present invention is where a user may desire to "sleep-in" if, for example, an out-of-town flight the next morning is cancelled. In this example, the user would have to input, for example, a post-set alert time, an airline website to query, and a selected event such as whether the flight he or she is on is cancelled. Then if the flight is cancelled during the night, this event will be communicated from the website, through the internet, and into processor 106. Processor 106 will then change the set alert time to the post-set alert time, and the user will be able to "sleep-in."

FIG. 2 illustrates only an exemplary method for alerting a user. Alert system 100 contemplates many of the steps in this flowchart taking place simultaneously and/or in a different order than as shown in FIG. 2. Furthermore, alert system 100 contemplates using methods with additional steps, fewer steps, or different steps, so long as the methods remain appropriate for alerting a user.

Although embodiments of the invention and their advantages are described in detail, a person skilled in the art could make various alternations, additions, and omissions without departing from the spirit and scope of the present invention as defined by the appended claims.

What is claimed is:

1. A system for alerting a user, comprising:

an input for establishing alarm conditions, the alarm conditions comprising a first alert time;

an interface for coupling to a communication network to obtain alarm data from a data source;

an alarm for alerting the user in response to an alarm signal, the alarm signal initially corresponding to the first alert time; and a processor operable to receive the alarm conditions, operable to control access to the data source over the communication network and in response to one or more of the alarm conditions, operable to receive and evaluate alarm data, and further operable to change the alarm signal to correspond to a second alert time in response to the evaluation.

2. The system of claim 1 wherein the input is a keypad.

3. The system of claim 1 wherein the alarm is an audio source operable to generate an audio signal.

4. The system of claim 3 wherein the audio signal provides advertising targeted to the user and received from the data source.

5. The system of claim 1 further comprising:

a first memory operable to store a computer program and the alarm conditions; and a second memory operable to store the alarm data.

6. The system of claim 1 wherein the interface is coupled to the communication network using a wireline connection.

7. The system of claim 1 wherein the interface is coupled to the communication network using a wireless connection.

8. The system of claim 1 wherein the data source provides data regarding traffic.

9. The system of claim 1 wherein the data source provides data regarding weather.

10. The system of claim 1 further comprising a snooze feature, the snooze feature operable to delay the alarm signal for a predetermined period.

11. The system of claim 10 wherein the snooze feature is activated by a switch.

12. The system of claim 1 further comprising at least one household device coupled to the processor.

13. A method for alerting a user, comprising:

inputting alarm conditions, where one of the alarm conditions is a first alert time, receiving data from at least one data source, the data corresponding to a selected event;

computing a second alert time in response to the data and the alarm conditions;

comparing the first alert time with the second alert time;

changing the first alert time to the second alert time; and activating an alarm at the second alert time.

14. The method of claim 13 further comprising generating an audio signal at the second alert time.

15. The method of claim 13 further comprising:

storing a computer program and the alarm conditions in a first memory;

storing the data received from the data source in a second memory; and executing the computer program, the computer program using the alarm conditions and data to compute the second alert time.

16. The method of claim 13 further comprising receiving the data using a wireline connection.

17. The method of claim 13 further comprising receiving the data using a wireless connection.

18. The method of claim 13 wherein the data source provides traffic information.

19. The method of claim 13 wherein the data source provides weather information.

20. The method of claim 13 further comprising delaying the alarm signal for a predetermined period using a snooze feature.

21. A method for alerting a user, comprising:

inputting user information having an alert time and alarm conditions;

setting an alarm to activate an audio signal at the alert time;

coupling to a web source;

querying the web source using the alarm conditions;

receiving data concerning the alarm conditions from the web source; and modifying the alert time when at least one of the alarm conditions exist.

22. The method of claim 21 further comprising:

storing a computer program and the user information in a first memory;

storing the data received from the web source in a second memory; and executing the computer program with a processor.

23. The method of claim 21 wherein coupling comprises using a wireline connection.

24. The method of claim 21 wherein coupling comprises using a wireless connection.

25. The method of claim 21 wherein the web source provides traffic information.

26. The method of claim 21 wherein the web source provides weather information.

27. The method of claim 21 further comprising delaying the audio signal for a predetermined period using a snooze feature.

* * * * *

UNITED STATES PATENT AND TRADEMARK OFFICE

CERTIFICATE OF CORRECTION

PATENT NO. : 6,229,430 B1
DATED : May 8, 2001
INVENTOR(S) : Mary Smith Dewey

It is certified that error appears in the above-identified patent and that said Letters Patent is hereby corrected as shown below:

Title page,
In the title, after "User" insert -- in Response to an Evaluation of Alarm Conditions and Alarm Data --.

Column 1,
Line 2, after "User" insert -- in Response to an Evaluation of Alarm Conditions and Alarm Data --.

Signed and Sealed this

Twenty-fifth Day of December, 2001

*Attest:*

*Attesting Officer*

JAMES E. ROGAN
*Director of the United States Patent and Trademark Office*